US012607084B2

(12) United States Patent
Sommerfeld et al.

(10) Patent No.: US 12,607,084 B2
(45) Date of Patent: Apr. 21, 2026

(54) SYSTEMS AND METHODS WITH SEAL ELEMENTS SHAPED TO EFFICIENTLY CEMENT CASING AND SEAL A HANGER IN A WELLHEAD HOUSING

(71) Applicant: Cameron International Corporation, Houston, TX (US)

(72) Inventors: Kyle Sommerfeld, Houston, TX (US); Andrew Sanders, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 19/065,456

(22) Filed: Feb. 27, 2025

(65) Prior Publication Data

US 2025/0277421 A1 Sep. 4, 2025

Related U.S. Application Data

(60) Provisional application No. 63/560,037, filed on Mar. 1, 2024.

(51) Int. Cl.

| | |
|---|---|
| ***E21B 33/05*** | (2006.01) |
| ***E21B 33/04*** | (2006.01) |
| ***E21B 33/14*** | (2006.01) |

(52) U.S. Cl.

CPC ..... *E21B 33/05* (2013.01); *E21B 33/0415* (2013.01); *E21B 33/14* (2013.01); *E21B 2200/01* (2020.05)

(58) Field of Classification Search

CPC ..... E21B 33/03; E21B 33/04; E21B 33/0415; E21B 33/05; E21B 33/085; E21B 33/14; E21B 2200/01

See application file for complete search history.

(56) References Cited

U.S. PATENT DOCUMENTS

| | | | | |
|---|---|---|---|---|
| 3,625,283 | A * | 12/1971 | Ahlstone | E21B 33/043 166/330 |
| 3,638,725 | A * | 2/1972 | Ahlstone | E21B 33/043 166/330 |
| 4,751,965 | A * | 6/1988 | Cassity | E21B 33/04 166/182 |
| 4,848,457 | A | 7/1989 | Lilley | |
| 7,836,946 | B2 * | 11/2010 | Bailey | E21B 36/001 166/84.2 |
| 8,851,194 | B2 * | 10/2014 | Ford | E21B 33/0422 166/368 |
| 9,234,403 | B2 * | 1/2016 | Lehr | E21B 33/129 |
| 9,611,717 | B2 | 4/2017 | Lockwood | |
| 10,689,935 | B2 * | 6/2020 | Levert, Jr. | E21B 23/02 |
| 11,499,387 | B2 * | 11/2022 | Levert, Jr. | E21B 23/02 |
| 2006/0144622 | A1 * | 7/2006 | Bailey | E21B 47/10 175/230 |

(Continued)

FOREIGN PATENT DOCUMENTS

| | | | | |
|---|---|---|---|---|
| GB | 2265400 A * | 9/1993 | | E21B 33/14 |
| WO | WO-2009129307 A2 * | 10/2009 | | E21B 33/043 |

*Primary Examiner* — Jennifer H Gay

(74) *Attorney, Agent, or Firm* — Kyle R. Miiller

(57) ABSTRACT

A wellhead includes a wellhead housing, a passage formed in or along the wellhead housing, a hanger configured to support a casing within the wellhead housing, and a seal assembly coupled to or integrally formed with the hanger. The seal assembly includes one or more seal elements with a wavy shape along a circumferential axis.

18 Claims, 12 Drawing Sheets

(56) References Cited

U.S. PATENT DOCUMENTS

| | | | | |
|---|---|---|---|---|
| 2008/0296845 | A1* | 12/2008 | Doane | E21B 33/1208 277/337 |
| 2012/0247788 | A1* | 10/2012 | Ford | E21B 33/0422 166/88.1 |
| 2014/0209293 | A1* | 7/2014 | Lehr | E21B 33/128 166/134 |
| 2016/0326824 | A1 | 11/2016 | Lugtmeier | |
| 2018/0258726 | A1* | 9/2018 | Levert, Jr. | E21B 33/04 |
| 2020/0392806 | A1* | 12/2020 | Levert, Jr. | E21B 23/02 |
| 2022/0018203 | A1 | 1/2022 | Bartlett | |
| 2024/0084664 | A1* | 3/2024 | Clark | E21B 33/085 |
| 2024/0426186 | A1* | 12/2024 | Sommerfeld | E21B 33/04 |
| 2024/0426188 | A1* | 12/2024 | Nguyen | E21B 33/04 |
| 2025/0277421 | A1* | 9/2025 | Sommerfeld | E21B 33/05 |

* cited by examiner

SYSTEMS AND METHODS WITH SEAL ELEMENTS SHAPED TO EFFICIENTLY CEMENT CASING AND SEAL A HANGER IN A WELLHEAD HOUSING

CROSS-REFERENCE TO RELATED APPLICATION

This application claims priority to and the benefit of U.S. Provisional Application Ser. No. 63/560,037, entitled "SYSTEMS AND METHODS WITH SEAL ELEMENTS SHAPED TO EFFICIENTLY CEMENT CASING AND SEAL A HANGER IN A WELLHEAD HOUSING" and filed Mar. 1, 2024, the disclosure of which is incorporated herein by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired natural resource is discovered below a surface of the earth, mineral extraction systems are often employed to access and extract the desired natural resource. The mineral extraction systems may be located onshore or offshore depending on the location of the desired natural resource. The mineral extraction systems generally include a wellhead through which the desired natural resource is extracted. The wellhead may include or be coupled to a wide variety of components, such as a tubing hanger that supports a tubing, a casing hanger that supports a casing, valves, fluid conduits, and the like.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a wellhead includes a wellhead housing, a passage formed in or along the wellhead housing, a hanger configured to support a casing within the wellhead housing, and a seal assembly coupled to or integrally formed with the hanger. The seal assembly includes one or more seal elements with a wavy shape along a circumferential axis.

In certain embodiments, a method of operating a wellhead includes running a hanger with a seal assembly into a wellhead housing, wherein the seal assembly includes one or more seal elements with a wavy shape along a circumferential axis. The method also includes performing cementing operations while the seal assembly is in a first position in which a first feature defined by the wavy shape is circumferentially aligned with a passage formed in the wellhead to enable a flow of fluid across the seal assembly via the passage. The method further includes after the cementing operations, rotating the seal assembly to a second position in which a second feature defined by the wavy shape is circumferentially aligned with the passage formed in the wellhead to block the flow of fluid across the seal assembly via the passage.

In certain embodiments, a wellhead includes a wellhead housing, a passage formed in or along the wellhead housing, a hanger configured to support a casing within the wellhead housing, and a seal assembly positioned about or within the hanger. The seal assembly comprises one or more annular seal elements that define one or more peaks and one or more valleys distributed along a circumferential axis.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure generally relate to systems and methods that support efficient casing installation operations. Certain embodiments of the present disclosure include a passage that is selectively sealed or isolated via a movable seal component. It should be appreciated that the passage may include a housing passage formed in or along a wellhead housing and/or a hanger passage formed in or along a hanger. To facilitate discussion herein, examples and embodiments are described with reference to the housing passage; however, it should be appreciated that the hanger passage may additionally or alternatively be provided to facilitate disclosed techniques.

In some cases, the movable seal component may be a seal assembly that is coupled to the hanger that supports the casing or that is integrally formed with the hanger. For example, during cementing operations, the seal assembly may be positioned to enable a flow of fluid through the housing passage formed in or along the wellhead housing. Then, after the cementing operations, the seal assembly may be positioned to block the flow of fluid through the housing passage formed in or along the wellhead housing (e.g., to seal the housing passage formed in or along the wellhead housing, as well as an annular space between the wellhead housing and the hanger).

Advantageously, the systems and methods disclosed herein enable the seal assembly to run with the hanger into the wellhead housing (e.g., rather than running the hanger into the wellhead housing, then conducting cementing operations, and then running the seal assembly into the wellhead housing). Accordingly, the systems and methods disclosed herein may save time and associated costs during drilling operations.

Figure 1:
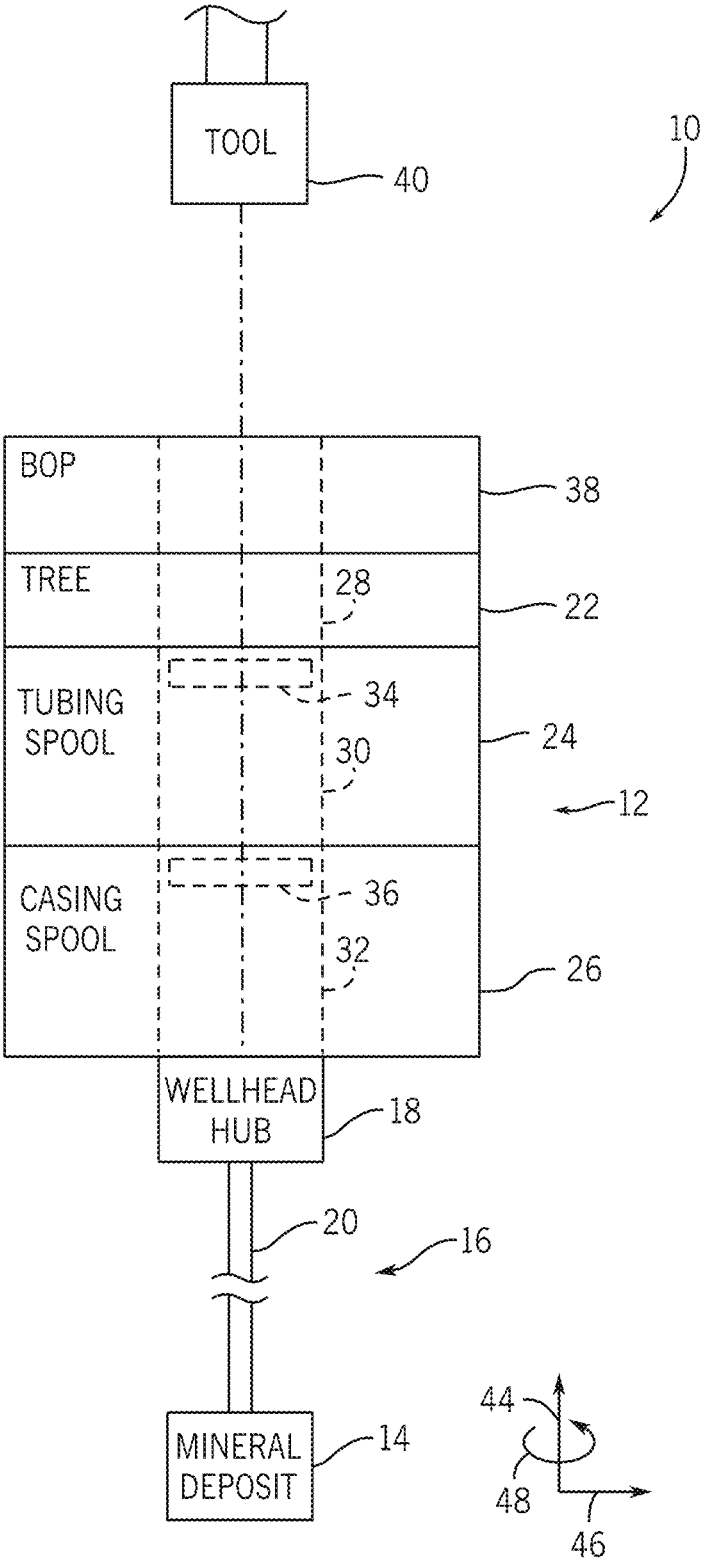
FIG. 1 is a block diagram of a mineral extraction system, in accordance with an embodiment of the present disclosure.

With the foregoing in mind, FIG. 1 is a block diagram of an embodiment of a mineral extraction system 10. The mineral extraction system 10 may be utilized to access and/or extract various natural resources (e.g., hydrocarbons, such as oil and/or natural gas) from the earth. As illustrated, the mineral extraction system 10 includes a wellhead 12 (e.g., annular wellhead) coupled to a mineral deposit 14 via a well 16. The well 16 may include a wellhead hub 18 (e.g., annular wellhead hub) and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools (e.g., a tool 40) into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. The tool 40 may be utilized to lower the tubing hanger 34 into the tubing spool 24 and/or the casing hanger 36 into the casing spool 26.

As discussed in more detail herein, a housing passage may be formed in or along a wellhead housing (e.g., a portion of the casing spool 26), and the housing passage is selectively sealed via a movable component (e.g., a seal assembly that may be integral to or separate from the hanger 34, 36, thus the movable component may include the hanger 34, 36). During cementing operations, the movable component may be positioned to enable a flow of fluid through the housing passage formed in or along the wellhead housing. Thus, the flow of fluid may pass from below the hanger and the seal assembly to above the hanger and the seal assembly (e.g., relative to the wellbore) via the housing passage. Then, after the cementing operations, the movable component may be positioned to block the flow of fluid through the housing passage formed in or along the wellhead housing (e.g., to seal the housing passage formed in or along the wellhead housing). In cases in which the seal assembly is integral to the hanger 34, 36, the seal assembly may move (e.g., rotate) with the hanger 34, 36 (e.g., via rotation of the hanger 34, 36; the seal assembly and the hanger 34, 36 rotate together). In cases in which the seal assembly is separate from the hanger 34, 36, the seal assembly may move (e.g., rotate) relative to the hanger 34, 36 (e.g., via rotation of the seal assembly without the hanger 34, 36). Thus, the flow of fluid may not pass from below the hanger and the seal assembly to above the hanger and the seal assembly via the housing passage. To facilitate discussion, the mineral extraction system 10, and the components therein, may be described with reference to an axial axis or direction 44, a radial axis or direction 46, and a circumferential axis or direction 48.

Figure 2:
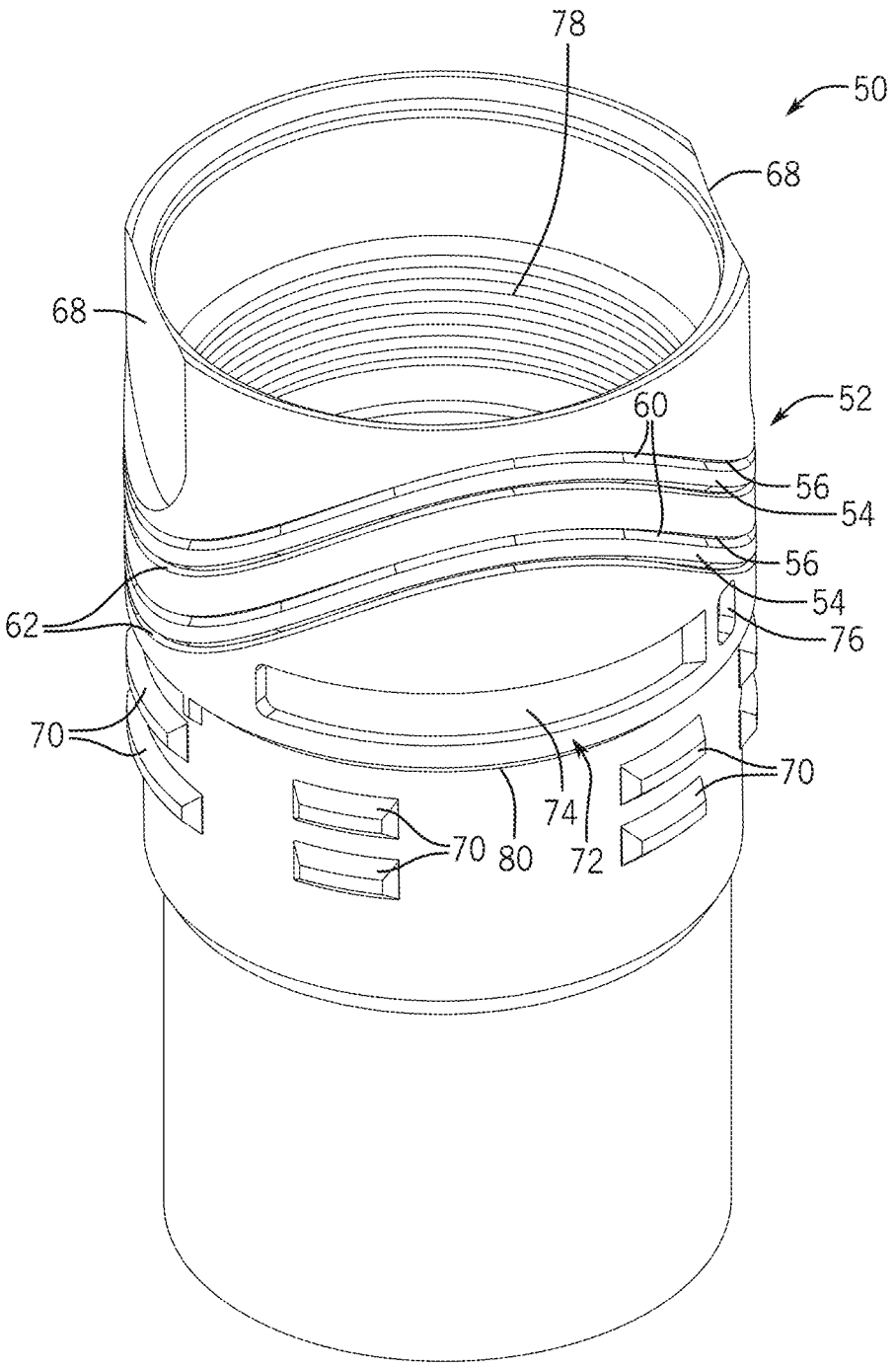
FIG. 2 is a perspective view of an embodiment of a hanger with a seal assembly that may be utilized in the mineral extraction system of FIG. 1.

FIG. 2 is a perspective view of an embodiment of a hanger 50 (e.g., a casing hanger, such as the casing hanger 36 of FIG. 1) with a seal assembly 52 (e.g., annular seal assembly). In certain embodiments, the seal assembly 52 is positioned about the hanger 50 and may include one or more annular seal elements 54 supported in one or more annular seal grooves 56 formed in the hanger 50 (e.g., a body of the hanger 50; a single, solid body that includes the one or more annular seal grooves 56 for the one or more annular seal elements 54 and that supports a casing; the seal assembly 52 is positioned about the hanger 50 and integral to the hanger 50). In this embodiment, the seal assembly 52 is configured to move (e.g., rotate) with the hanger 50 (e.g., via rotation of the hanger 50).

As shown, the seal assembly 52 includes the one or more annular seal grooves 56 and the one or more annular seal elements 54 with a wavy shape (e.g., sine wave; undulating or oscillating shape) that extends along the circumferential axis 48. For example, in FIG. 2, the wavy shape includes peaks 60 and valleys 62, and the peaks 60 and valleys 62 may alternate along the circumferential axis 48. In particular, in FIG. 2, the wavy shape includes opposed peaks 60 on opposite sides of the hanger 50 and opposed valleys 62 on opposite sides of the hanger 50. When the opposed peaks 60 are on opposite sides of the hanger 50, the opposed peaks 60 are diametrically opposed across the hanger 50 and are offset or separated by 180 degrees about the hanger 50). Similarly, when the opposed valleys 62 are on opposite sides of the hanger 50, the opposed valleys 62 are diametrically opposed across the hanger 50 and are offset or separated by 180 degrees about the hanger 50. This configuration also positions the peaks 60 and valleys 62 to be offset or separated by 90 degrees about the hanger 50.

While the seal assembly 52 is shown to include the wavy shape with two peaks 60 and two valleys 62, it should be appreciated that the seal assembly 52 may include any suitable number of peaks 60 and valleys 62 (e.g., 2, 3, 4, or more peaks 60 and 2, 3, 4, or more valleys 62) about the hanger 50. Further, while the seal assembly 52 is shown to include two annular grooves 56 that support two annular seal elements 54, it should be appreciated that the seal assembly 52 may include any suitable number of annular grooves 56 and annular seal elements 54 (e.g., 1, 2, 3, 4, or more; at least one; at least two). In embodiments with multiple annular grooves 56 and multiple annular seal elements 54, the multiple annular grooves 56 and multiple annular seal elements 54 may be stacked or distributed along the axial axis 44.

As shown, the hanger 50 also includes one or more flow-by grooves 68, which are recessed portions formed in a radially-outer surface of the hanger 50. The one or more flow-by grooves 68 are aligned (e.g., overlap) with the valleys 62 along the circumferential axis 48 and are also above the valleys 62 along the axial axis 44 relative to a wellbore. The hanger 50 also includes one or more teeth 70 (e.g., protrusions) formed on the radially-outer surface of the hanger 50. The one or more teeth 70 extend partially along the circumferential axis 48 about the hanger 50. The hanger 50 also includes a retainer slot 72 that receives a stopper (e.g., pin) coupled to a wellhead housing. The retainer slot 72 may include an elongated section 74 (e.g., shown in FIG. 2) and a stop section 76 (e.g., adjacent to and spaced apart from the elongated section 74 along the circumferential axis 48, shown in FIG. 2). The hanger 50 also includes threads 78, which may threadably couple the hanger 50 to a running tool. The hanger 50 also includes a shoulder 80 (e.g., annular shoulder), which may land on a corresponding surface or shoulder of the wellhead housing. As described herein, features of the hanger 50 facilitate efficient cementing and sealing operations.

Figure 3:
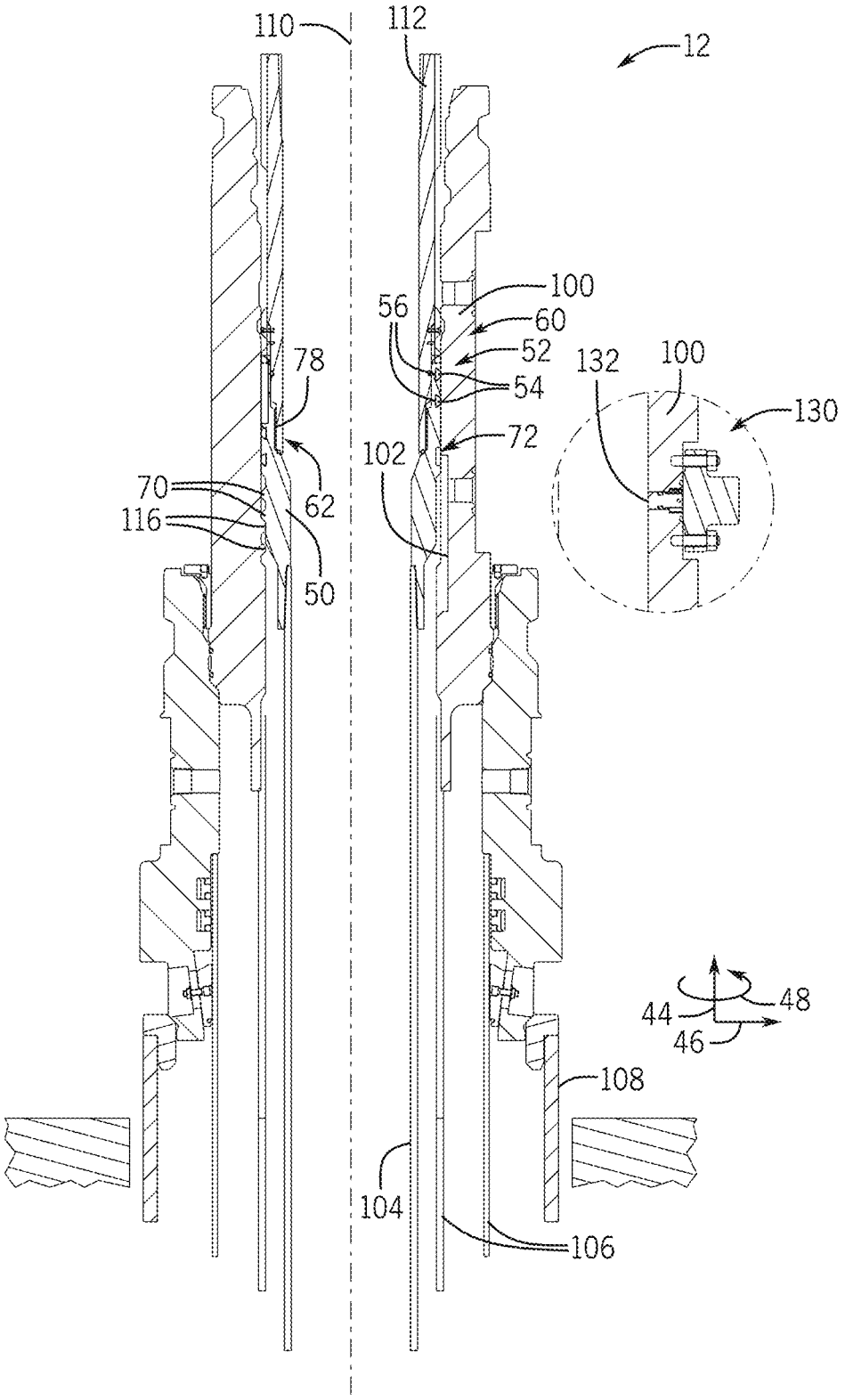
FIG. 3 is a modified cross-sectional side view of an embodiment of a portion of a wellhead that includes a wellhead housing with a housing passage, wherein the hanger with the seal assembly of FIG. 2 is configured to move within the wellhead housing to selectively seal or isolate the housing passage.
Figure 4:
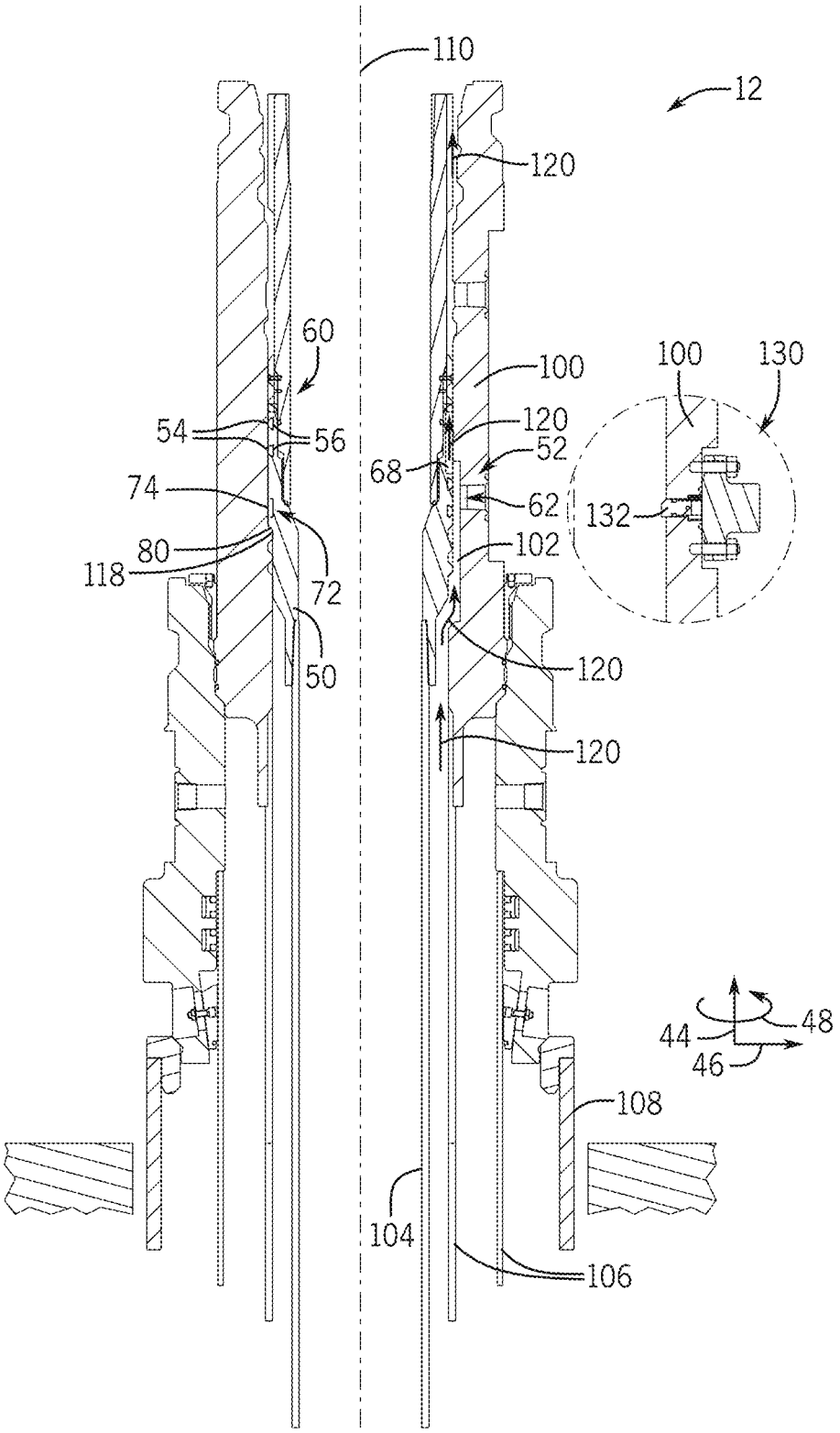
FIG. 4 is a modified cross-sectional side view of an embodiment of the portion of the wellhead of FIG. 3, wherein the hanger with the seal assembly of FIG. 2 is positioned within the wellhead housing to enable the flow of fluid through the housing passage.
Figure 5:
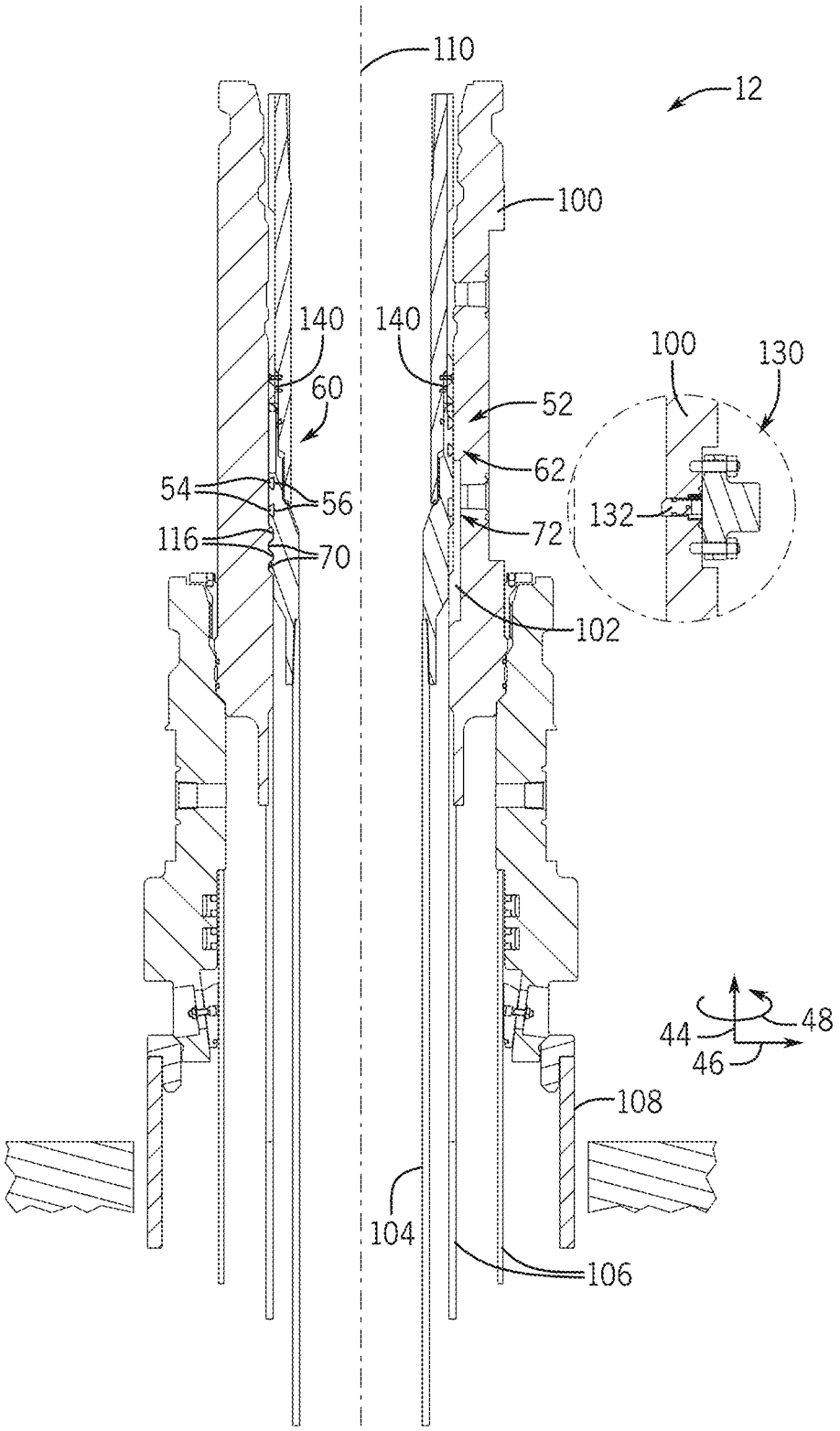
FIG. 5 is a modified cross-sectional side view of an embodiment of the portion of the wellhead of FIG. 3, wherein the hanger with the seal assembly of FIG. 2 is positioned within the wellhead housing to block the flow of fluid through the housing passage.

FIGS. 3-5 are modified cross-sectional side views of an embodiment of a portion of the wellhead 12 that includes a wellhead housing 100 (e.g., a portion of a casing spool, such as a portion of the casing spool 26 of FIG. 1) with a housing passage 102 (e.g., groove). The hanger 50 is positioned in the wellhead housing 100 and suspends a casing 104 that extends into a wellbore. For example, the casing 104 may pass through one or more additional casings 106 and/or a conductor 108 to extend into the wellbore.

The seal assembly 52 (e.g., annular seal assembly) is positioned about and integral to the hanger 50. As shown, the seal assembly 52 may include the one or more annular seal elements 54 supported in the one or more annular seal grooves 56 formed in the hanger 50. As described herein, the seal assembly 52 may include a wavy shape, such that the one or more annular seal elements 54 includes or form peaks 60 and valleys 62 about the hanger 50. In such a configuration, respective crests (e.g., a highest portion or point) of the peaks 60 and respective troughs (e.g., a lowest portion or point) of the valleys 62 are at different locations relative to the axial axis 44. Thus, when the seal assembly 52 is installed in the wellhead 12, the respective crests of the peaks 60 and the respective troughs of the valleys 62 are at different locations relative to the wellbore. More particularly, when the seal assembly 52 is installed in the wellhead 12, the respective crests of the peaks 60 are positioned further from the wellbore relative to the respective troughs of the valleys 62, and the respective troughs of the valleys 62 are positioned closer to the wellbore relative to the respective crests of the peaks 60. As described herein, the peaks 60 and the valleys 62 may alternate along the circumferential axis 48. In certain embodiments, the peaks 60 (e.g., the respective crests of opposed peaks 60) are positioned on opposite sides of the hanger 50 and the valleys 62 (e.g., respective crests of opposed valleys 62) are positioned on opposite sides of the hanger 50.

As shown, the housing passage 102 provides an enlarged inner diameter of the wellhead housing 100 (e.g., relative to portions of the wellhead housing 100 above and/or below the housing passage 102), such that the seal assembly 52 (e.g., the one or more annular seal elements 54 of the seal assembly 52) do not contact and do not seal against a radially-inner surface of the wellhead housing 100 when the seal assembly 52 is aligned with (e.g., faces) the housing passage 102.

To facilitate discussion of the seal assembly 52 and its operation during cementing and sealing operations, FIGS. 3-5 are modified cross-sectional side views of the portion of the wellhead 12. In particular, FIGS. 3-5 illustrate the peaks 60 on one side of a center axis 110 and the valleys 62 on another side of the center axis 110, even though the seal assembly 52 may include opposed peaks 60 on opposite sides of the hanger 50 and opposed valleys 62 on opposite sides of the hanger 50 (e.g., such as in the configuration show in FIG. 2).

In operation, with reference to FIG. 3, a running tool 112 that is threadably coupled to the hanger 50 via the threads 78 of the hanger 50 may lower the hanger 50 with the casing 104 and the seal assembly 52 into the wellhead housing 100. The running tool 112 may lower the hanger 50 with the one or more teeth 70 of the hanger 50 circumferentially offset from one or more corresponding teeth 116 of the wellhead housing 100.

With reference to FIG. 4, the running tool 112 may move (e.g., lower and/or rotate) the hanger 50 with the casing 104 and the seal assembly 52 relative to the wellhead housing 100 until the hanger 50 reaches a landed position in the wellhead housing 100. For example, the shoulder 80 of the hanger 50 may radially overlap with a corresponding shoulder 118 of the wellhead housing 100 to block further movement of the hanger 50 relative to the wellhead housing 100 toward the wellbore.

Once the hanger 50 is in the landed position in the wellhead housing 100, cementing operations may commence to cement the casing 104 within the wellbore. In particular, with the hanger 50 in the landed position in the wellhead housing 100, the valleys 62 of the seal assembly 52 and the one or more flow-by grooves 68 of the hanger 50 are aligned with the housing passage 102 along the circumferential axis 48. Further, with the hanger 50 in the landed position in the wellhead housing 100, the valleys 62 of the seal assembly 52 are aligned with the housing passage 102 along the axial axis 44, and also the one or more flow-by grooves 68 of the hanger 50 overlap or are exposed (e.g., fluidly exposed or coupled) to the housing passage 102 along the axial axis 44.

Thus, with the hanger 50 in the landed position in the wellhead housing 100, the seal assembly 52 is positioned to enable the fluid flow through or along the housing passage 102, as shown by arrows 120. Then, the fluid flow may travel from the housing passage 102, across the seal assembly 52, and through or along the one or more flow-by grooves 68 of the hanger 50. Thus, the fluid flow may travel from a first side of the hanger 50 and the seal assembly 52 to a second side of the hanger 50 and the seal assembly 52 along the axial axis 44 (e.g., across the hanger 50 and the seal assembly 52 relative to the axial axis 44).

With reference to FIG. 5, once the cementing operations are complete, the seal assembly 52 may be adjusted (e.g., moved, repositioned, rotated). In particular, when the seal assembly 52 is integral to the hanger 50 as shown in FIGS. 3-5, the seal assembly 52 may be adjusted via the hanger 50. The running tool 112 may move (e.g., rotate) the hanger 50 with the casing 104 and the seal assembly 52 relative to the wellhead housing 100 until the one or more teeth 70 of the hanger 50 engage and circumferentially align with the one or more corresponding teeth 116 of the wellhead housing 100. For example, the one or more teeth 70 of the hanger 50 may radially overlap and stack axially with the one or more corresponding teeth 116 of the wellhead housing 100. Such engagement between the one or more teeth 70 of the hanger 50 and the one or more corresponding teeth 116 of the wellhead housing 100 may block axial movement of the hanger 50 relative to the wellhead housing 100, and thus, effectively provides or operates as a load shoulder and a lock for the hanger 50.

Additionally, as shown in FIG. 5, rotation of the seal assembly 52 (e.g., via the rotation of the hanger 50) from its position shown in FIG. 4 to its position shown in FIG. 5 causes the peaks 60 of the seal assembly 52 to align with the housing passage 102 along the circumferential axis 48. Thus, the peaks 60 are positioned above the housing passage 102 along the axial axis 44 relative to the wellbore. Accordingly, the seal assembly 52 provides an annular seal between the hanger 50 and the wellhead housing 100.

As shown in FIGS. 3-5, a lock 130 may be coupled to the wellhead housing 100. The lock 130 may include a stopper 132 (e.g., pin) that engages the retainer slot 72 of the hanger 50. In FIG. 3, the stopper 132 may be driven (e.g., retracted, withdrawn) into the wellhead housing 100 due to contact with a radially-outer surface of the hanger 50 as the running tool 112 lowers the hanger 50 into the wellhead housing 100. In FIG. 4, in response to the hanger 50 reaching the landed position and/or while the hanger 50 is in the landed position, the stopper 132 may align with the elongated section 74 of the retainer slot 72 along the circumferential axis 48 and the axial axis 44, and thus the stopper 132 may engage and extend radially inwardly into the elongated section 74 of the retainer slot 72 (e.g., automatically engage and extend due a recessed configuration of the retainer slot 72 and corresponding increased radial space between the wellhead housing 100 and the hanger 50). In FIG. 5, in response to the rotation of the hanger 50, the stopper 132 may align with the stop section 76 (see FIG. 3) of the retainer slot 72 along the circumferential axis 48 and the axial axis 44, and thus the stopper 132 may engage and extend radially inwardly into the stop section 76 of the retainer slot 72 (e.g., automatically disengage and retract from the elongated section 74 of the retainer slot 72 due to contact with the radially-outer surface of the hanger 50 between the elongated section 74 and the stop section 76 of the retainer slot 72, and then automatically engage and extend into the stop section 76 of the retainer slot 72 due a recessed configuration of the retainer slot 72 and corresponding increased radial space between the wellhead housing 100 and the hanger 50).

Such engagement between the stopper 132 and the stop section 76 of the retainer slot 72 may block back spinning or reverse rotation of the hanger 50 (and thus, the seal assembly 52, at least when the seal assembly 52 is integrally formed with the hanger 50) within the wellhead housing 100. Once the hanger 50 is locked in the wellhead housing 100, the running tool 112 may be rotated to break shear pins 140 and enable separation (e.g., unthreading) of the running tool 112 from the hanger 50. It should be appreciated that other components, such as a ratchet or clutch, may be utilized in addition to or instead of the shear pins 140 to enable or allow a limited amount of torque transfer between the running tool 112 and the hanger 50 to facilitate techniques disclosed herein. It should also be appreciated that the lock 130 and/or other components, such as a protrusions between the hanger 50 and the wellhead housing 100, may also provide a stop to block movement of the hanger 50 once the hanger 50 reaches a desired position in the wellhead housing 100.

Thus, as shown and described herein, the housing passage 102 provides a bypass pathway for fluid flow between a first axial location within the wellhead housing 100 and a second axial location within the wellhead housing 100 (e.g., above the first axial location relative to the wellbore). Further, the hanger 50 and the seal assembly 52 include various features to enable use of the housing passage 102 in this manner. For example, the hanger 50 includes the one or more flow-by grooves 68, an arrangement of the one or more teeth 70, and also supports the seal assembly 52. Further, the seal assembly 52 includes the wavy shape (e.g., the peaks 60 and the valleys 62) to selectively open and close the housing passage 102 via rotation of the seal assembly 52 relative to the wellhead housing 100.

In this way, the running tool 112 may lower the hanger 50 with the casing 104 and the seal assembly 52 into the wellhead housing 100, and the seal assembly 52 may remain in the wellhead housing 100 during the cementing operations. Further, in some embodiments, no additional seal packoff elements or steps are utilized to provide the seal between the hanger 50 and the wellhead housing 100 after the cementing operations.

It should be appreciated that the wellhead housing 100 may include one housing passage 102 or multiple housing passages 102 distributed (e.g., spaced apart) about the circumferential axis 48 (e.g., at discrete locations about the circumferential axis 48). For example, the multiple housing passages 102 may include 2, 3, 4, or more housing passages 102 that each extend along the axial axis 44. Advantageously, the multiple housing passages 102 may provide additional flow-by area (e.g., as compared to a single housing passage 102) and/or dedicated housing passage(s) 102 for certain stages or levels of hangers and casings.

For example, in some such cases, a first one of the multiple housing passages 102 may be at a first circumferential location, and a second one of the multiple housing passages 102 may be at a second circumferential location, wherein the first circumferential location is different from the second circumferential location (e.g., offset along the circumferential axis 48). More specifically, the first one of the multiple housing passages 102 may be opposed to the second one of the multiple housing passages 102, such that a first one of the valleys 62 may align with and enable the fluid flow through the first one of the multiple housing passages 102 and a second one of the valleys 62 may align with and enable the fluid flow through the second one of the multiple housing passages 102 during cementing operations. Then, a first one of the peaks 60 may align with and block the fluid flow through the first one of the multiple housing passages 102 and a second one of the peaks 60 may align with and block the fluid flow through the second one of the multiple housing passages 102 after the cementing operations (e.g., to provide the annular seal between the hanger 50 and the wellhead housing 100).

It should be appreciated that the wellhead housing 100 and the hanger 50 shown in FIGS. 2-5 may be adapted to include different structural features. For example, as shown in more detail with respect to FIGS. 9-13, the seal assembly 52 may be a separate structure (e.g., not integrated into the hanger 50). Additionally or alternatively, the one or more housing passages 102 may not be formed as open grooves, but instead may be one or more housing passages (e.g., holes; circumferentially surrounded by a wall of the wellhead housing 100) formed through or in the wellhead housing 100. In certain embodiments, the lock 130 may have any suitable components in any suitable configuration, such as a lock ring supported in the wellhead housing 100.

Figure 6:
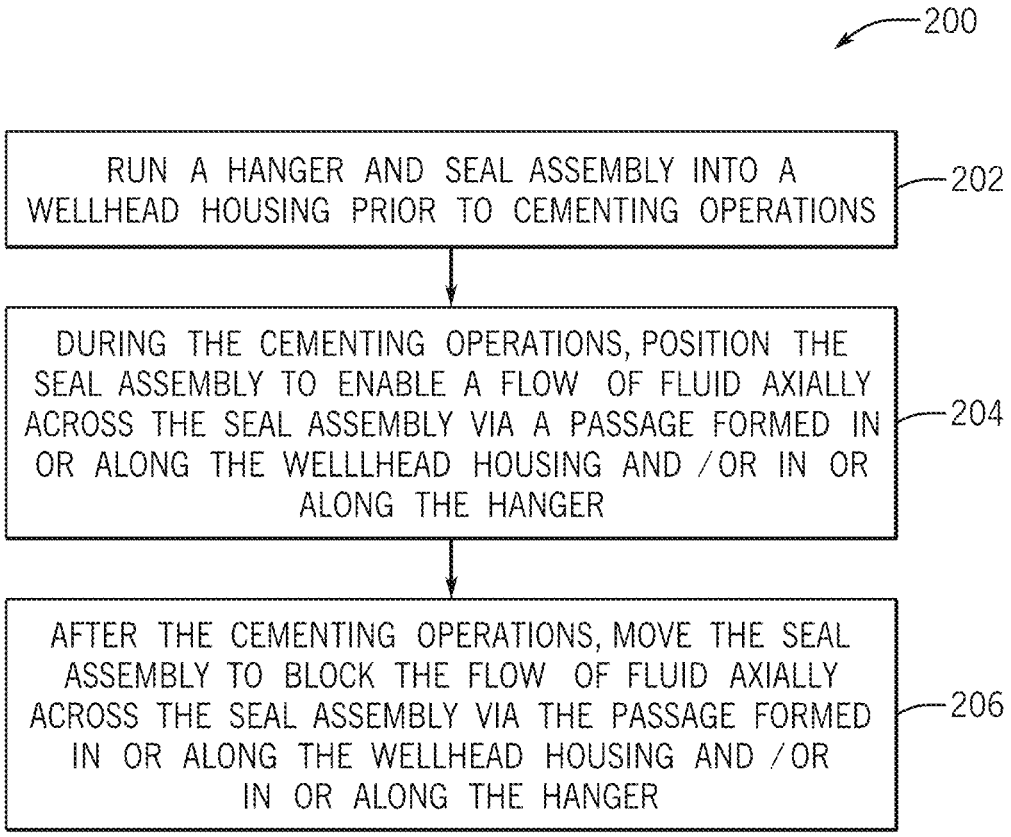
FIG. 6 is a flow diagram of an embodiment of a method of operating a wellhead to efficiently route fluid through a passage of a wellhead housing and/or a hanger and to seal the hanger in the wellhead housing.

FIG. 6 is a flow diagram of an embodiment of a method 200 of operating a wellhead (e.g., the wellhead 12 of FIGS. 1-5) to efficiently route fluid through a passage of a wellhead housing and/or a hanger, and to seal the hanger in the wellhead housing. The method 200 disclosed herein includes various steps represented by blocks. It should be noted that at least some steps of the method 200 may be performed as an automated procedure by a system, such as an electronic control system for the wellhead. Although the flow chart illustrates the steps in a certain sequence, it should be understood that the steps may be performed in any suitable order and certain steps may be carried out simultaneously, where appropriate.

In block 202, the method 200 may begin with running a hanger and a seal assembly into a wellhead housing. The seal assembly may include one or more annular seals (e.g., elastomer or metal seals; o-rings) that are configured to seal an annular space between the hanger and the wellhead housing. The seal assembly may include the one or more annular seals supported directly on the hanger (e.g., in grooves formed in a body of the hanger; the seal assembly is integrated into the hanger or is part of hanger), or the seal assembly may include the one or more annular seals supported on an annular body (e.g., grooves formed in the annular body) that is coupled to and/or that circumferentially surrounds a portion of the hanger. The seal assembly may include a wavy shape with peaks and valleys.

In block 204, cementing operations may commence once the hanger and the seal assembly are positioned (e.g., landed) in the wellhead housing. During the cementing operations, the seal assembly may be positioned to enable a flow of fluid axially across the seal assembly via a passage formed in or along the wellhead housing and/or in or along the hanger. For example, the seal assembly may include valleys, and at least one of the valleys may be aligned with the passage to enable cement returns to travel through or along the passage. In this way, the passage may be open (e.g., not sealed, blocked, and/or obstructed by the seal assembly to enable the flow of fluid axially across the seal assembly via the passage. In certain embodiments, the passage may include a groove (e.g., radially expanded portion; relatively large inner diameter) of the wellhead housing and/or in or along the hanger. The groove may be open (e.g., with a radial gap between the hanger and the groove) to enable the flow of fluid axially across the seal assembly via the groove.

In block 206, after the cementing operations, the seal assembly may be positioned to block the flow of fluid axially across the seal assembly via the passage formed in or along the wellhead housing and/or in or along the hanger. For example, the seal assembly may be rotated relative to the passage (e.g., rotated via and/or with the hanger, such as when the seal assembly is integrated into the hanger; rotated separately from and relative to the hanger, such as when the seal assembly is supported on the annular body that is separate from the hanger), such that at least one of the peaks may be aligned with the passage to block the flow of fluid axially across the seal assembly via the passage. Further, this may cause the seal assembly to form an annular seal between the hanger and the wellhead housing.

Figure 8:
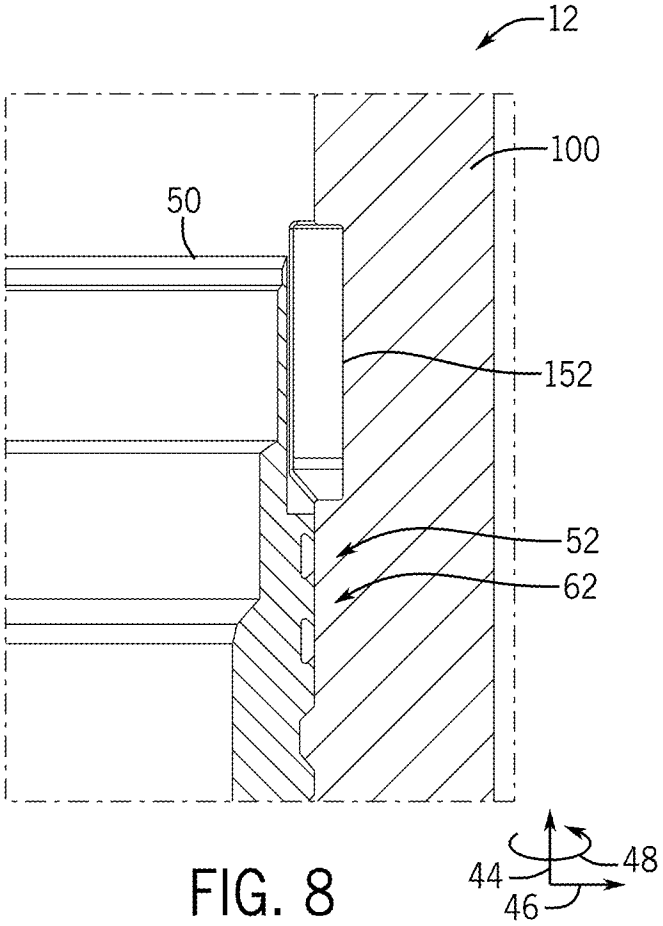
FIG. 8 is a cross-sectional side view of an embodiment of the portion of the wellhead of FIG. 7, wherein the hanger with the seal assembly of FIG. 2 is positioned within the wellhead housing to block the flow of fluid through the housing passage.
Figure 7:
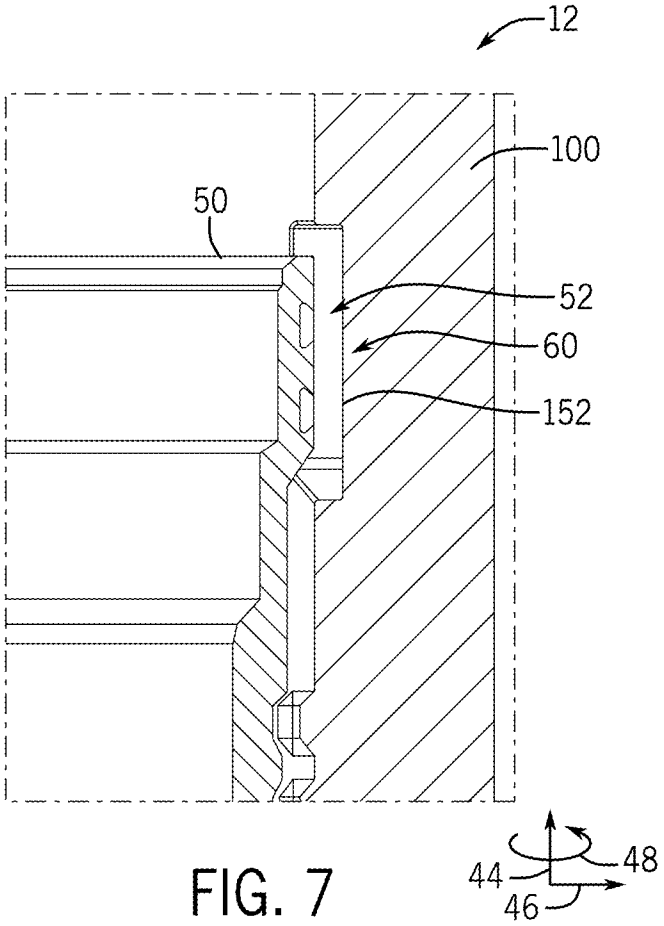
FIG. 7 is a cross-sectional side view of an embodiment of a portion of a wellhead that includes a wellhead housing with a housing passage, wherein the hanger with the seal assembly of FIG. 2 is positioned within the wellhead housing to enable the flow of fluid through the housing passage.

FIGS. 7 and 8 are cross-sectional side views of an embodiment of a portion of the wellhead 12 that includes a wellhead housing 100 (e.g., a portion of a casing spool, such as a portion of the casing spool 26 of FIG. 1) with a housing passage 152 (e.g., groove). As shown in FIG. 7, the peaks 60 of the seal assembly 52 are aligned with the housing passage 152 along the axial axis 44. Thus, the seal assembly 52 is positioned to enable the fluid flow through or along the housing passage 152. Then, the fluid flow may travel through the housing passage 152 and across the seal assembly 52. Thus, the fluid flow may travel from a first side of the hanger 50 and the seal assembly 52 to a second side of the hanger 50 and the seal assembly 52 along the axial axis 44 (e.g., across the hanger 50 and the seal assembly 52 relative to the axial axis 44).

With reference to FIG. 8, once the cementing operations are complete, the running tool may move (e.g., rotate) the seal assembly 52 (e.g., with and/or via the hanger 50 in FIG. 8) relative to the wellhead housing 100. Such rotation of the seal assembly 52 from its position shown in FIG. 7 to its position shown in FIG. 8 causes the valleys 62 of the seal assembly 52 to align with the housing passage 152 along the circumferential axis 48. Thus, the valleys 62 are positioned below the housing passage 152 along the axial axis 44 relative to the wellbore. Accordingly, the seal assembly 52 provides an annular seal between the hanger 50 and the wellhead housing 100. It should be appreciated that the wellhead housing 100 may include the housing passage 102 of FIGS. 3-5 and/or the housing passage 152 of FIGS. 7 and 8.

Figure 9:
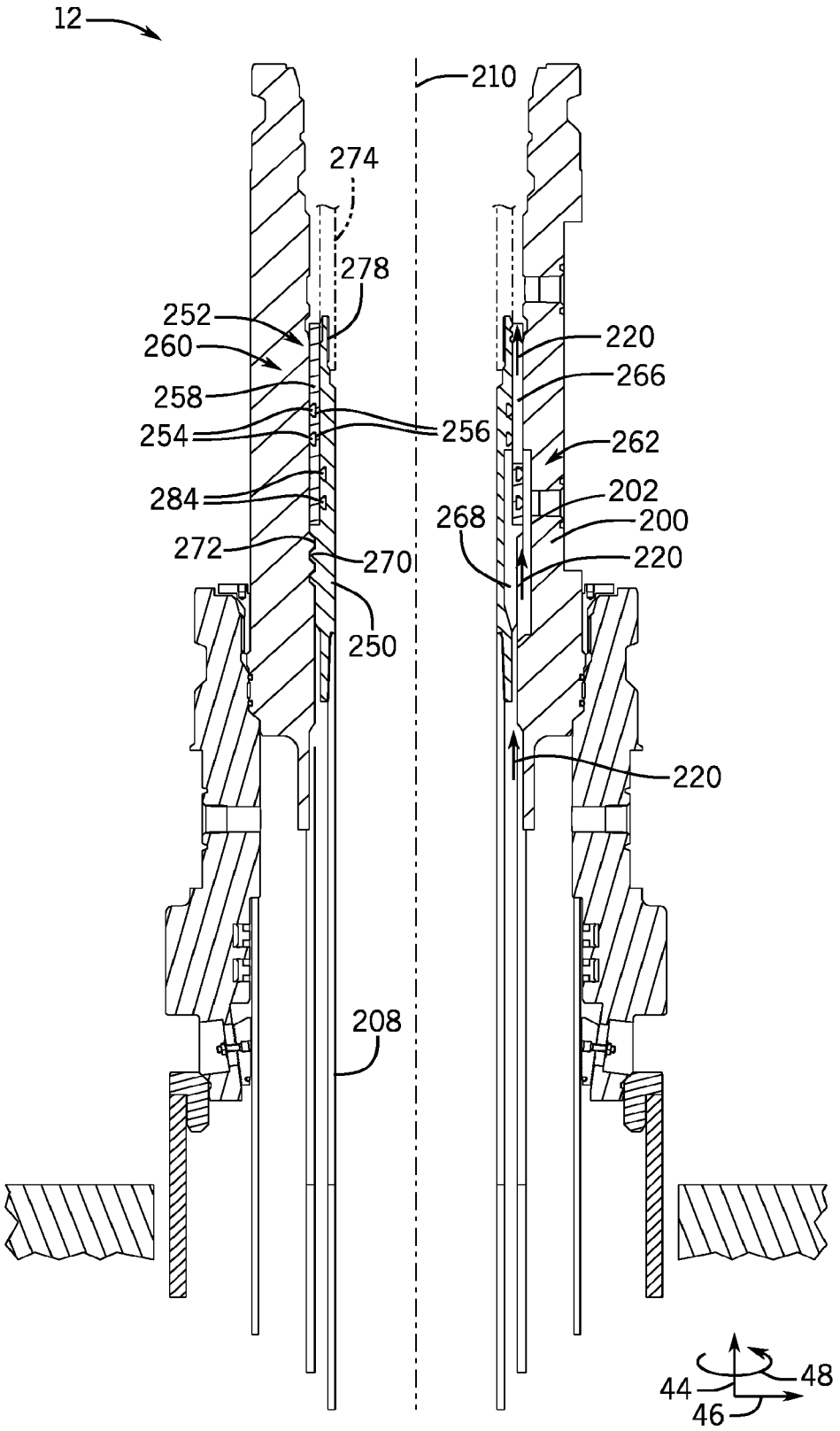
FIG. 9 is a modified cross-sectional side view of an embodiment of a portion of a wellhead that includes a wellhead housing with a housing passage, wherein a seal assembly is positioned about a hanger and is positioned within the wellhead housing to enable a flow of fluid through the housing passage.
Figure 10:
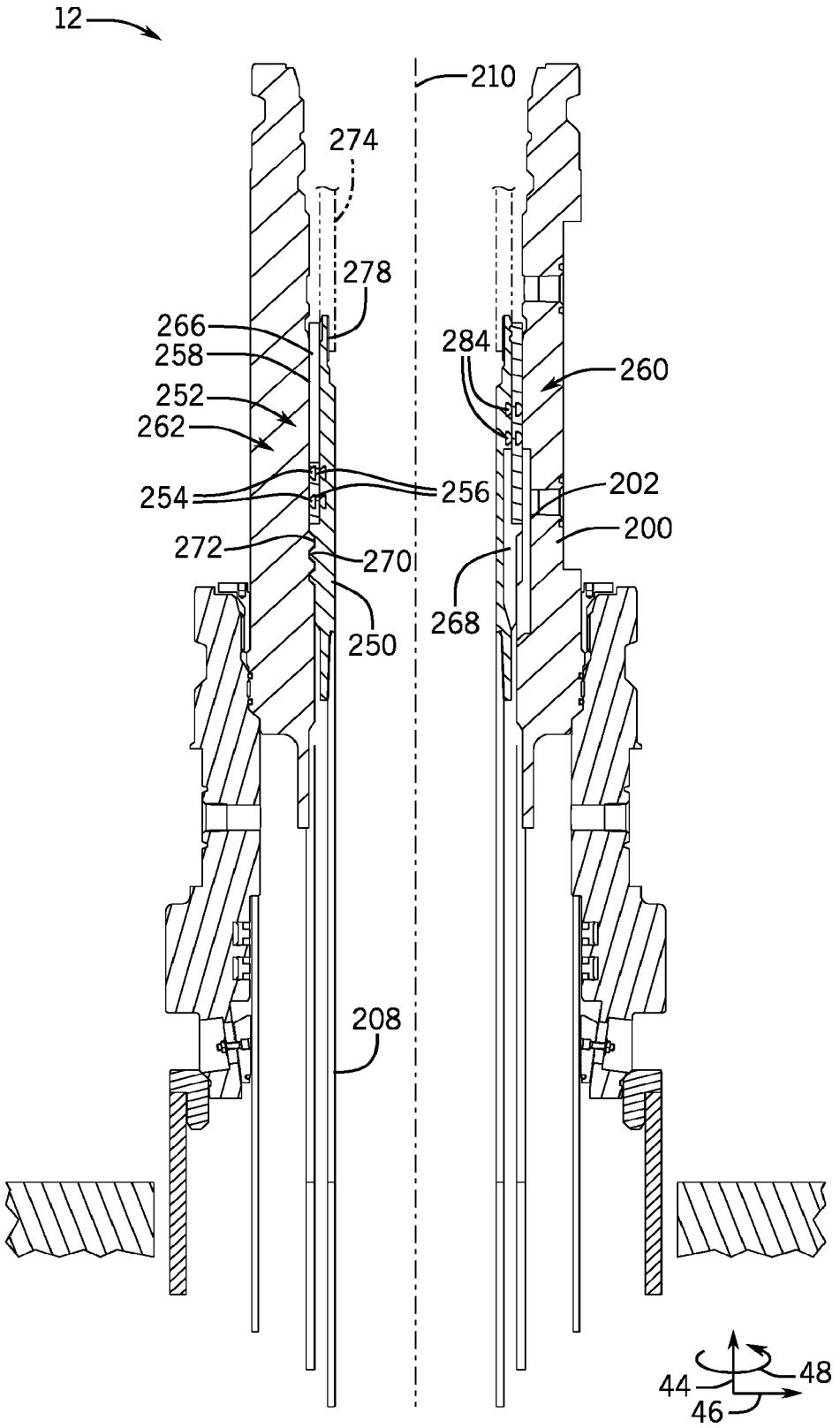
FIG. 10 is a modified cross-sectional side view of an embodiment of the portion of the wellhead of FIG. 9, wherein the seal assembly is positioned within the wellhead housing to block the flow of fluid through the housing passage.

FIG. 9 is a modified cross-sectional side view of an embodiment of a portion of the wellhead 12 that includes a wellhead housing 200 with a housing passage 202, wherein a seal assembly 252 is positioned about a hanger 250 and is positioned within the wellhead housing 200 to enable a flow of fluid through the housing passage 202. FIG. 10 is a modified cross-sectional side view of an embodiment of the portion of the wellhead 12 of FIG. 9, wherein the seal assembly 252 is positioned within the wellhead housing 200 to block the flow of fluid through the housing passage 202.

As shown, the seal assembly 252 includes one or more annular seal elements 254 supported in one or more annular seal grooves 256 formed in an annular body 258 that is positioned about the hanger 250. The annular body 258 may be a single, solid body that is physically separate and distinct from the hanger 250 that suspends and supports a casing 208.

As shown, the seal assembly 252 includes the one or more annular seal grooves 256 and the one or more annular seal elements 254 with a wavy shape (e.g., sine wave; undulating or oscillating shape) that extends along the circumferential axis 48. For example, in FIGS. 9 and 10, the wavy shape includes peaks 260 and valleys 262, and the peaks 260 and valleys 262 may alternate along the circumferential axis 48. In particular, in FIGS. 9 and 10, the wavy shape includes opposed peaks 260 on opposite sides of the hanger 250 and opposed valleys 262 on opposite sides of the hanger 250.

It should be appreciated that the seal assembly 252 may include any suitable number of peaks 260 and valleys 262 about the annular body 258, and thus about the hanger 250. Further, it should be appreciated that the seal assembly 252 may include any suitable number of annular seal grooves 256 and annular seal elements 254. In embodiments with multiple annular seal grooves 256 and multiple annular seal elements 254, the multiple annular seal grooves 256 and multiple annular seal elements 254 may be stacked or distributed along the axial axis 44.

As shown, the hanger 250 includes one or more flow-by grooves 268, which may be recessed portions formed in a radially-outer surface of the hanger 250. Additionally, the annular body 258 includes one or more additional flow-by grooves 266, which may be recessed portions and/or radial spaces (e.g., gaps) defined in the annular body 258. As shown, the housing passage 202 provides an enlarged inner diameter along a portion of the wellhead housing 200 (e.g., relative to portions of the wellhead housing 200 above and/or below the housing passage 202; partially along the circumferential axis 48 about the wellhead housing 200), such that the one or more annular seal elements 254 of the seal assembly 252 do not contact and do not seal against a radially-inner surface of the wellhead housing 200 when the one or more annular seal elements 254 of the seal assembly 252 are axially aligned with (e.g., face; overlap) the housing passage 102. As described herein, the one or more flow-by grooves 268, the one or more additional flow-by grooves 266, and/or the housing passage 202 may fluidly couple to enable the flow of fluid across the hanger 250 and the seal assembly 252 under certain conditions, such as while the seal assembly 252 is positioned to enable the flow of fluid in this manner. It should be appreciated that various combinations of one or more flow-by grooves and/or one or more passages are envisioned. For example, the one or more flow by grooves 268 and the one or more additional flow-by grooves 266 may be arranged to enable the flow of fluid across the hanger 250 and the seal assembly 252 without presence of the housing passage 202. The hanger 250 also includes one or more teeth 270 (e.g., protrusions) formed on the radially-outer surface of the hanger 250. The one or more teeth 270 extend partially along the circumferential axis 48 about the hanger 250.

To facilitate discussion of the seal assembly 252 and its operation during cementing and sealing operations, FIGS. 9 and 10 are modified cross-sectional side views of the portion of the wellhead 12. In particular, FIGS. 9 and 10 illustrate the peaks 260 on one side of a center axis 210 and the valleys 262 on another side of the center axis 210, even though the seal assembly 252 may include opposed peaks 260 on opposite sides of the hanger 250 and opposed valleys 262 on opposite sides of the hanger 250 (e.g., such as in the configuration show in FIG. 2).

In operation, a running tool 274 may be coupled to the hanger 250 via threads 278, and the running tool 274 may be operated to lower the hanger 250 with the one or more teeth 270 of the hanger 250 circumferentially offset from one or more corresponding teeth 272 of the wellhead housing 200. The running tool 274 may have any suitable shape, and is represented in one example shape in dashed lines to facilitate discussion. Once the one or more teeth 270 and the one or more corresponding teeth 272 are properly aligned relative to the axial axis 44, the running tool 274 may be operated to rotate the hanger 250 to engage (e.g., cause overlap relative to the circumferential axis 48; land and/or lock) the one or more teeth 270 with the one or more corresponding teeth 272 to thereby block movement of the hanger 250 relative to the wellhead housing 200 along the axial axis 44. Then, as described herein, cementing operations may commence to cement the casing 208 within the wellbore.

To facilitate or enable the cementing operations, the hanger 250 and the seal assembly 252 may be positioned such that the valleys 262 and the one or more additional flow-by grooves 266 of the seal assembly 252 are aligned with the housing passage 202 along the circumferential axis 48. Further, the hanger 250 and the seal assembly 252 may be positioned such that the valleys 262 of the seal assembly 252 are aligned with the housing passage 202 along the axial axis 44, and also the one or more flow-by grooves 268 of the hanger 250 overlap or are exposed (e.g., fluidly exposed or coupled) to the housing passage 202 along the axial axis 44. As noted above, the hanger 250 may include the one or more flow-by grooves 268 and/or passages that may be utilized in addition to or as an alternative to the housing passage 202. In any case, with the hanger 250 and the seal assembly 252 positioned in the wellhead housing 200 in this manner and as shown in FIG. 9, the flow of fluid may travel as shown by arrows 220. Thus, the fluid flow may travel from a first side of the hanger 250 and the seal assembly 252 to a second side of the hanger 250 and the seal assembly 252 along the axial axis 44 (e.g., across the hanger 250 and the seal assembly 252 relative to the axial axis 44).

With reference to FIG. 10, once the cementing operations are complete, the running tool 274 may move (e.g., rotate) to unthread from the hanger 250. The running tool 274 may be coupled to the seal assembly 252, such as via one or more shear pins (e.g., extending axially between the running tool 274 and the annular body 258). Thus, the rotation of the running tool 274 to unthread the running tool 274 from the hanger 250 may cause rotation of the seal assembly 252. Additionally, the hanger 250 and the seal assembly 252 may include an interface (e.g., castellations) that blocks rotation of the seal assembly 252 by more than a certain rotation relative to the hanger 250 (e.g., allows 90 degrees of rotation, and blocks further rotation). As such, when the seal assembly 252 reaches this limit, further rotation of the running tool 274 causes the one or more shear pins to break to allow the further rotation and eventual withdrawal of the running tool 274.

Thus, the rotation of the running tool 274 and connections between the running tool 274, the hanger 250, and the seal assembly 252 may rotate the seal assembly 252 from the position of FIG. 9 (e.g., with the valleys 262 and the one or more additional flow-by grooves 266 circumferentially aligned with the housing passage 202 and/or the one or more flow-by grooves 268) to the position of FIG. 10 (e.g., with the peaks 260 and the one or more additional flow-by grooves 266 circumferentially aligned with the housing passage 202 and/or the one or more flow-by grooves 268). In this way, the peaks 260 are positioned above the housing passage 202 and/or the one or more flow-by grooves 268 along the axial axis 44 relative to the wellbore. Accordingly, the seal assembly 252 provides an annular seal between the hanger 250 and the wellhead housing 200.

In this way, the running tool 274 may lower the hanger 250 with the casing 208 and the seal assembly 252 into the wellhead housing 200, and the seal assembly 252 may remain in the wellhead housing 200 during the cementing operations. It should be appreciated that the hanger 250 may include additional features, such as one or more annular seal elements 284 with a respective wavy shape (e.g., peaks and valleys; corresponding to the wavy shape of the one or more annular seal elements 254). However, in some embodiments, no additional seal packoff elements or steps are utilized to provide the seal between the hanger 250 and the wellhead housing 200 after the cementing operations.

Figure 11:
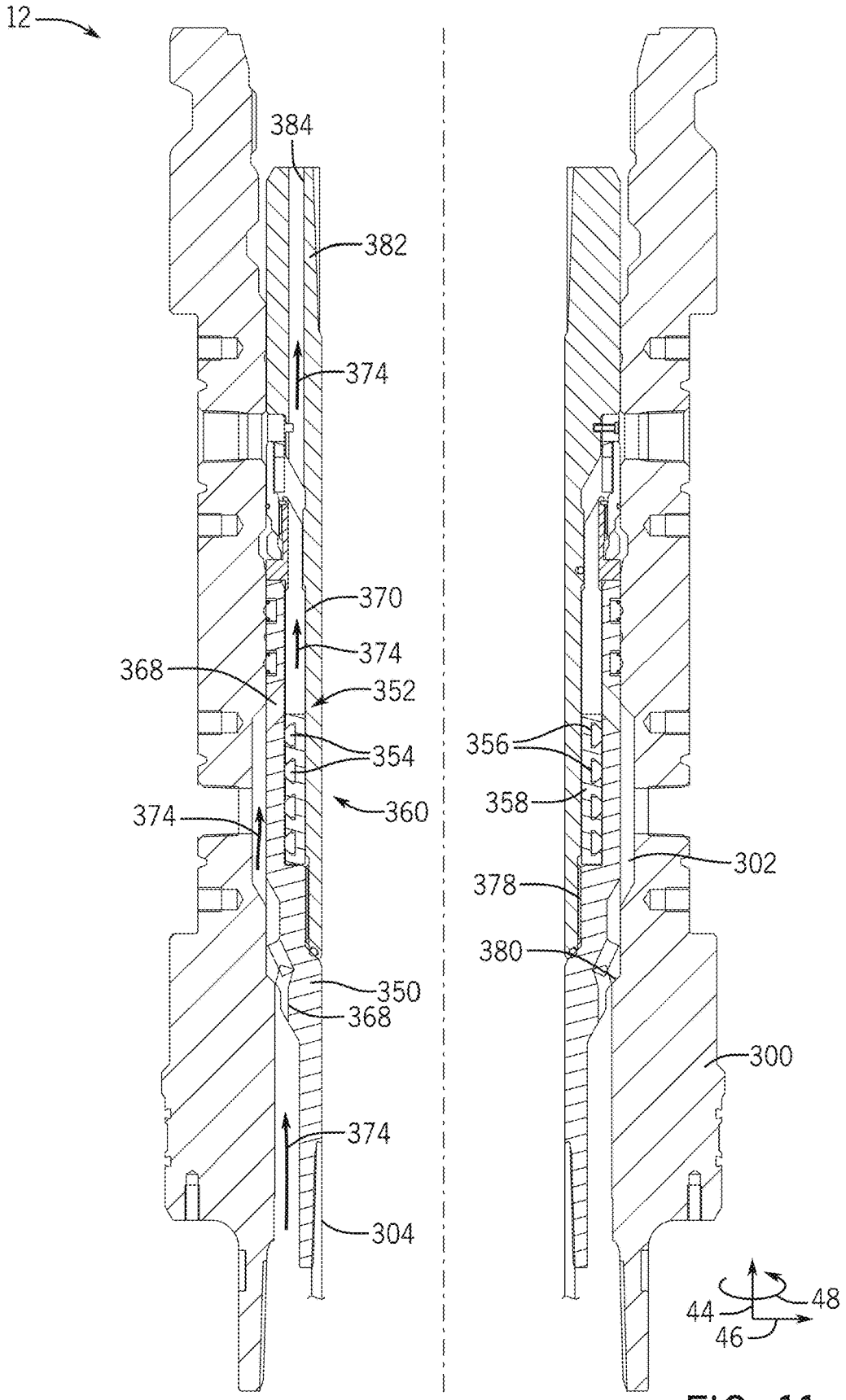
FIG. 11 is a cross-sectional side view of an embodiment of a portion of a wellhead that includes a wellhead housing with a housing passage, wherein a seal assembly is coupled to a hanger and is positioned within the wellhead housing to enable the flow of fluid through the housing passage.
Figure 12:
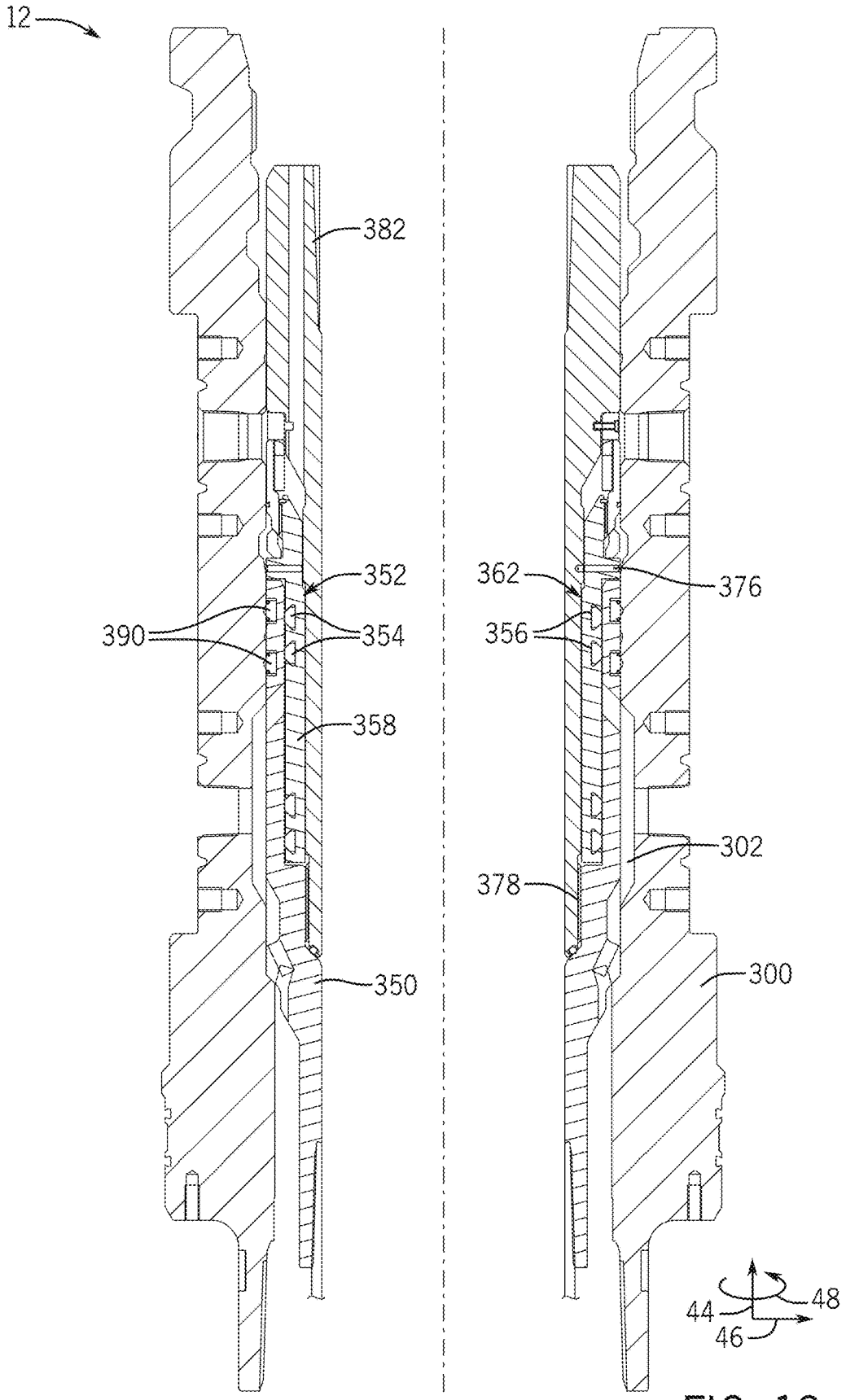
FIG. 12 is a cross-sectional side view of an embodiment of the portion of the wellhead of FIG. 11, wherein the seal assembly is positioned within the wellhead housing to block the flow of fluid through the housing passage.
Figure 13:
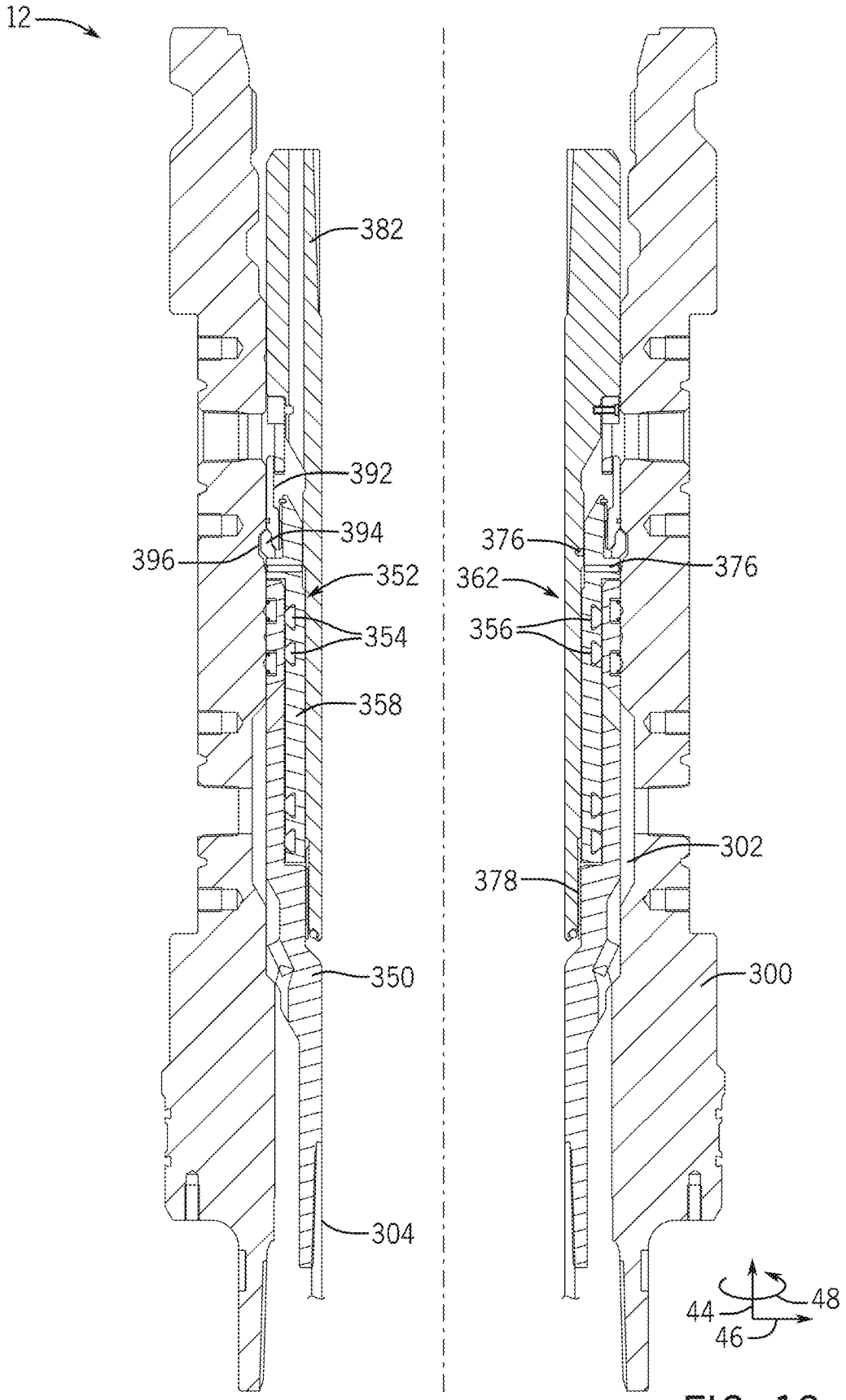
FIG. 13 is a cross-sectional side view of an embodiment of the portion of the wellhead of FIG. 11, wherein the seal assembly is locked within the wellhead housing.

FIG. 11 is a cross-sectional side view of an embodiment of a portion of the wellhead 12 that includes a wellhead housing 300 with a housing passage 302, wherein a seal assembly 352 is coupled to a hanger 350 and is positioned within the wellhead housing 300 to enable the flow of fluid through the housing passage 302. FIG. 12 is a cross-sectional side view of an embodiment of the portion of the wellhead 12 of FIG. 11, wherein the seal assembly 352 is positioned within the wellhead housing 300 to block the flow of fluid through the housing passage 302. FIG. 13 is a cross-sectional side view of an embodiment of the portion of the wellhead 12 of FIG. 11, wherein the seal assembly 352 is locked within the wellhead housing 300.

In FIG. 11, the seal assembly 352 includes one or more annular seal elements 354 supported in one or more annular seal grooves 356 formed in an annular body 358 that is positioned about the hanger 350. The annular body 358 may be a single, solid body that is physically separate and distinct from the hanger 350 that suspends and supports a casing 304.

As shown, the seal assembly 352 includes the one or more annular seal grooves 356 and the one or more annular seal elements 354 with a wavy shape (e.g., sine wave; undulating or oscillating shape) that extends along the circumferential axis 48. For example, with reference to FIGS. 11-13, the wavy shape includes peaks 360 and valleys 362, and the peaks 360 and valleys 362 may alternate along the circumferential axis 48. In particular, in FIGS. 11-13, the wavy shape includes opposed peaks 360 on opposite sides of the annular body 358 and opposed valleys 362 on opposite sides of the annular body 358.

It should be appreciated that the seal assembly 352 may include any suitable number of peaks 260 and valleys 262 about the annular body 358, and thus about the hanger 350. Further, it should be appreciated that the seal assembly 352 may include any suitable number of annular seal grooves 356 and annular seal elements 354. In embodiments with multiple annular seal grooves 356 and multiple annular seal elements 354, the multiple annular seal grooves 356 and multiple annular seal elements 354 may be stacked or distributed along the axial axis 44.

As shown in FIG. 11, the housing passage 302 may include a radially expanded portion (e.g., relatively large inner diameter) that extends circumferentially about a radially-inner surface of the wellhead housing 300 (e.g., annular passage; an entirety of the radially-inner surface of the wellhead housing 300). Additionally the hanger 350 includes one or more flow-by grooves 368, which may be openings (e.g., through-holes) formed through the hanger 350 (e.g., extend between and open to multiple surfaces of the hanger 350). The hanger 350 also includes a shoulder 380 (e.g., annular shoulder), which may land on a corresponding surface or shoulder of the wellhead housing. The annular body 358 may also include one or more additional flow-by grooves 370, which may be openings (e.g., through-holes; channels) formed through the annular body 358 (e.g., extend between and open to multiple surfaces of the annular body 358). As shown in FIGS. 12 and 13, one or more shear pins 376 may couple the annular body 358 to a running tool 382. Additionally, the annular body 358 includes threads 378, which may threadably couple the hanger 350 to the running tool 382.

In operation, with reference to FIG. 11, the running tool 382 may be operated to lower the annular body 358 with the hanger 350 that suspends the casing 304 into the wellhead housing 300. The running tool 382 may lower the annular body 358 with the hanger 350 relative to the wellhead housing 300 until the hanger 350 reaches a landed position in the wellhead housing 300. While the hanger 350 and the seal assembly 352 may be set with an initial relative position (e.g., relative rotational position; as lowered into the wellhead housing 300; with the one or more flow-by grooves 368 and the one or more additional flow-by grooves 370 circumferentially aligned and fluidly coupled to one another, advantageously the hanger 350 and the seal assembly 352 may be lowered and positioned in any orientation (e.g., relative to the wellhead housing 300; relative rotational position) to carry out techniques described herein.

Once the hanger 350 is in the landed position in the wellhead housing 300, cementing operations may commence to cement the casing 304 within the wellbore. In particular, with the hanger 350 in the landed position in the wellhead housing 300 and with the annular body 358 in a first position (e.g., circumferential position or configuration relative to the hanger 350), the valleys 362 of the seal assembly 352 are positioned to enable a flow of fluid to travel across the seal assembly 352. In particular, the valleys 362 of the seal assembly 352 are positioned to enable the flow of fluid to pass through the one or more flow-by grooves 368 of the hanger 350, through the housing passage 102, and through the one or more additional flow-by grooves 370 of the annular body 358 as shown by arrows 374. In certain embodiments, the running tool 382 may also include one or more channels 384 that fluidly couple to the one or more additional flow-by grooves 370 of the annular body 358. Thus, the fluid flow may travel from a first side of the hanger 350 and the seal assembly 352 to a second side of the hanger 350 and the seal assembly 352 along the axial axis 44 (e.g., across the hanger 350 and the seal assembly 352 relative to the axial axis 44).

With reference to FIG. 12, once the cementing operations are complete, the running tool 382 may move (e.g., rotate) to unthread from the hanger 350. The running tool 382 may be coupled to the seal assembly 352 via the one or more shear pins 376. Thus, the rotation of the running tool 382 to unthread the running tool 382 from the hanger 350 may cause rotation of the seal assembly 352. Additionally, the hanger 350 and the seal assembly 352 may include an interface (e.g., castellations) that blocks rotation of the seal assembly 352 by more than a certain rotation relative to the hanger 350 (e.g., allows 90 degrees of rotation, and blocks further rotation). As such, when the seal assembly 352 reaches this limit, further rotation of the running tool 382 causes the one or more shear pins 376 to break to allow the further rotation and eventual withdrawal of the running tool 382.

Thus, the rotation of the running tool 382 and connections between the running tool 382, the hanger 350, and the seal assembly 352 may rotate the seal assembly 352 from the position of FIG. 11 (e.g., with the valleys 362 and the one or more additional flow-by grooves 370 circumferentially aligned with the one or more flow-by grooves 368) to the position of FIG. 12 (e.g., with the peaks 360 and the one or more additional flow-by grooves 370 circumferentially aligned with the one or more flow-by grooves 368). In this way, the peaks 360 are positioned above the one or more flow-by grooves 368 along the axial axis 44 relative to the wellbore. Accordingly, the seal assembly 352 provides an annular seal between the hanger 350 and the wellhead housing 300.

With reference to FIG. 13, a push ring 392 (e.g., annular ring) is threadably coupled to the hanger 350, and the running tool 382 may engage with the push ring 392 via an interface (e.g., castellations). Additionally, respective threads between the hanger 250 and the push ring 392 may have a different thread direction as compared to respective threads between the hanger 350 and the running tool 382. Such features enable or cause rotation of the running tool 382 to unthread the running tool 382 from the hanger 350, while simultaneously rotating the push ring 392 and driving the push ring 392 toward a lock ring 394 (e.g., c-ring). In particular, the push ring 392 may insert between the lock ring 394 and a portion of the annular body 358, which may force the lock ring 394 to expand radially outwardly into a lock ring groove 396 formed in the wellhead housing 300. In this way, the seal assembly 352 may be locked within the wellhead housing 300 and may continue to block the flow of fluid across the hanger 350 and the seal assembly 352.

Thus, as shown and described herein, the housing passage 302 provides a bypass pathway for fluid flow between a first axial location within the wellhead housing 300 and a second axial location within the wellhead housing 300 (e.g., above the first axial location relative to the wellbore). Further, the hanger 350 and the seal assembly 352 include various features to enable use of the housing passage 302 in this manner. For example, the hanger 350 includes the one or more flow-by grooves 368. Further, the seal assembly 352 includes the wavy shape (e.g., the peaks 360 and the valleys 362) to selectively open and close the housing passage 302 via rotation of the seal assembly 352, as well as the one or more additional flow-by grooves 370.

In this way, the running tool 382 may lower the hanger 350 with the casing 304 and the seal assembly 352 into the wellhead housing 300, and the seal assembly 352 may remain in the wellhead housing 300 during the cementing operations. It should be appreciated that the hanger 350 may include additional features, such as one or more annular seal elements 390 that contact and form an additional annular seal against the wellhead housing 300. However, in some embodiments, no additional seal packoff elements or steps are utilized to provide the seal between the hanger 350 and the wellhead housing 300 after the cementing operations.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show a hanger and a housing of a wellhead, it should be understood that the systems and methods may be adapted to for use with any of a variety of other annular structures.

Additionally, any features shown or described with reference to FIGS. 1-13 may be combined in any suitable manner. For example, certain embodiments shown with annular seals integral to a hanger may instead include a separate seal assembly structure coupled to the hanger. As another example, certain embodiments shown with a groove formed along a radially-inner surface of the wellhead housing may instead include a passage formed through a wellhead housing. As yet another example, a passage formed in or along a wellhead housing may couple to a hanger passage, a tool passage, and/or any other suitable flow path (e.g., axially below and/or above a seal assembly relative to a wellbore) to facilitate techniques disclosed herein. As yet another example, a wellhead housing may include a housing passage positioned to align with valleys of a seal assembly and an additional housing passage positioned to align with peaks of the seal assembly.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A wellhead, comprising:

a wellhead housing;

a passage formed in or along the wellhead housing;

a hanger configured to support a casing within the wellhead housing; and a seal assembly coupled to or integrally formed with the hanger, wherein the seal assembly comprises one or more seal elements with a wavy shape along a circumferential axis and the seal assembly is configured to rotate within the wellhead housing to circumferentially align at least one valley defined by the wavy shape or at least one peak defined by the wavy shape with the passage to enable a flow of fluid across the seal assembly via the passage.

2. The wellhead of claim 1, wherein the seal assembly is configured to rotate within the wellhead housing to circumferentially align at least one peak defined by the wavy shape or at least one valley defined by the wavy shape with the passage to block a flow of fluid across the seal assembly via the passage.

3. The wellhead of claim 2, wherein the seal assembly is integrally formed with the hanger, and the seal assembly is configured to rotate within the wellhead housing by rotation of the hanger within the wellhead housing.

4. The wellhead of claim 1, wherein the passage comprises a groove formed along a radially-inner wall of the wellhead housing.

5. The wellhead of claim 1, wherein the seal assembly is configured to selectively enable a flow of fluid through the passage, and the flow of fluid comprises cement returns.

6. The wellhead of claim 1, comprising a lock to block movement of the hanger within the wellhead housing, wherein the lock is configured to engage a retainer slot formed in a radially-outer surface of the hanger to block movement of the hanger within the wellhead housing.

7. The wellhead of claim 1, wherein the seal assembly is integrally formed with the hanger, the hanger comprises one or more annular seal grooves formed in a radially-outer wall of the hanger, and the one or more seal elements are positioned in the one or more annular seal grooves.

8. The wellhead of claim 1, wherein the seal assembly comprises an annular body coupled to the hanger, the annular body comprises one or more annular seal grooves formed in a radially-outer wall of the annular body, and the one or more seal elements are positioned in the one or more annular seal grooves.

9. The wellhead of claim 1, wherein the wavy shape comprises at least two valleys and at least two peaks.

10. The wellhead of claim 1, wherein the wavy shape comprises two diametrically opposed valleys and two diametrically opposed peaks.

11. The wellhead of claim 1, wherein the one or more seal elements comprises multiple seal elements spaced apart along an axial axis.

12. A method of operating a wellhead, the method comprising:

running a hanger with a seal assembly into a wellhead housing, wherein the seal assembly comprises one or more seal elements with a wavy shape along a circumferential axis;

performing cementing operations while the seal assembly is in a first position in which a first feature defined by the wavy shape is circumferentially aligned with a passage formed in the wellhead to enable a flow of fluid across the seal assembly via the passage; and after the cementing operations, rotating the seal assembly to a second position in which a second feature defined by the wavy shape is circumferentially aligned with the passage formed in the wellhead to block the flow of fluid across the seal assembly via the passage.

13. The method of claim 12, wherein the first feature comprises a valley, and the second feature comprises a peak.

14. The method of claim 12, comprising running the hanger with the seal assembly into the wellhead housing with one or more teeth of the hanger circumferentially offset from one or more corresponding teeth of the wellhead housing to facilitate placement of the seal assembly in the first position.

15. The method of claim 12, comprising engaging a retainer slot in the hanger with a lock supported by the wellhead housing to block movement of the hanger relative to the wellhead housing.

16. A wellhead, comprising:

a wellhead housing;

a passage formed in or along the wellhead housing;

a hanger configured to support a casing within the wellhead housing; and a seal assembly positioned about or within the hanger, wherein the seal assembly comprises one or more annular seal elements that define one or more peaks and one or more valleys distributed along a circumferential axis and the seal assembly is configured to rotate within the wellhead housing to circumferentially align at least one valley of the one or more valleys or at least one peak of the one or more peaks with the passage to enable a flow of fluid across the seal assembly via the passage.

17. The wellhead of claim 16, wherein the hanger, the seal assembly, or both comprise one or more flow-by grooves that are aligned with the one or more valleys.

18. The wellhead of claim 16, wherein the seal assembly is configured to rotate within the wellhead housing to circumferentially align at least one peak of the one or more peaks or at least one valley of the one or more valleys with the passage to block a flow of fluid across the seal assembly via the passage.

* * * * *